United States Patent [19]

Dutcher

[11] Patent Number: 5,005,701

[45] Date of Patent: Apr. 9, 1991

[54] STRENGTHENING STRUT FOR RECTANGULAR CONTAINER

[75] Inventor: Daniel P. Dutcher, Bethel, Minn.

[73] Assignee: Waldorf Corporation, St. Paul, Minn.

[21] Appl. No.: 582,112

[22] Filed: Sep. 12, 1990

[51] Int. Cl.[5] ..... B65D 5/10

[52] U.S. Cl. ..... 206/491; 206/45.14; 206/45.34; 229/162

[58] Field of Search ..... 206/45.14, 45.34, 491; 229/162

[56] References Cited

U.S. PATENT DOCUMENTS

| | | | |
|---|---|---|---|
| 2,759,654 | 8/1956 | Lugt, Jr. | 206/491 X |
| 2,764,337 | 9/1956 | Bolding | 206/491 X |
| 3,583,755 | 8/1972 | Struble . | |
| 3,693,866 | 9/1972 | Struble | 206/491 X |
| 3,887,067 | 6/1975 | Collura et al. | 206/491 |
| 4,128,168 | 12/1978 | Roccaforte | 206/491 |

OTHER PUBLICATIONS

Revlon, "Hi & Dri Powder Fresh Roll-On Anti-Perspirant Deodorant", Ser. No. 592-01, UPC No. 0998-5307-00.

Procter & Gamble, "Sure Wide Solid Anti-Perspirant Deodorant, Desert Spiece Scent", UPC No. 37000 71758.

*Primary Examiner*—William I. Price

*Attorney, Agent, or Firm*—Dorsey & Whitney

[57] ABSTRACT

A package of thin, flexible material for positioning an article contained within the package has an exterior container having generally the shape of a rectangular box made with first and second opposed main panel pairs joined at ninety degrees to form a tube of rectangular cross-section and a pair of end closures at opposite ends of said tube. An internal positioning frame exists within the exterior container. The internal positioning frame has a pair of generally parallel positioning panels, each such positioning panel being parallel to the first pair of main panels and both such positioning panels being connected to one of the second pair of main panels. A first positioning strut is connected between the parallel positioning panels and lies generally perpendicular to each of the parallel positioning panels and in spaced, generally parallel relation to the second pair of main panels. A second positioning strut is connected between the first positioning strut and at least one of the first pair of main panels. The second positioning strut lies generally parallel to said parallel positioning panels and in a plane intermediate the planes of said parallel positioning panels.

14 Claims, 6 Drawing Sheets

12
53
56
51
21
29
20
108
70
50
22
71
100
49
46
39
42
32
34
120
30

12
130
34
42
120
100
109
108
50
90
141
22
70
35
140
30
20
21
51
53
41
32
40
110
141
140

STRENGTHENING STRUT FOR RECTANGULAR CONTAINER

This is a continuation of application Ser. No. 07/485,268 filed Feb. 26, 1990 now abandoned.

BACKGROUND OF THE INVENTION

1. Field of the Invention

The present invention relates to packaging. More particularly, the present invention relates to a generally rectangular package of paperboard or other flexible material that contains an internal frame structure used to position and hold an article that is placed in the package.

2. Description of the Prior Art

Packaging has become an important part of the marketplace image of many products, in addition to serving to protect the products packaged. For many products of irregular shape, it is desired to package the product in a rectangular carton to simplify and regularize packing in cartons and to give a neat appearance to shelf displays. At the same time, it is often a goal of the package to display the product attractively through apertures or windows in the package. When a package is somewhat larger than the article it contains, it becomes necessary to use a structure internal to the outer walls of the package to position and hold the article relative to the apertures or windows. The same internal structure may also be used to cushion the article or to keep it from shifting freely within the package.

In prior art packages, various folded and/or glued panels have been used to form the internal positioning structure. In one form of package often used for small products such as a roll-on deodorant bottle, the product has been positioned by means of a pair of parallel panels connected by a strut. The product rests between the parallel panels and it is constrained by the strut against motion in a direction parallel to the panels. Because the strut is a relatively narrow strip of paperboard, it may become warped or bent, permitting the product to escape the position that the internal positioning structure was designed to hold. An internal positioning structure having greater integrity and ability to hold a product securely would be a desirable improvement over the known prior art.

SUMMARY OF THE INVENTION

A package for positioning an article contained within the package has an exterior container having generally the shape of a rectangular box made with first and second opposed main panel pairs joined at ninety degrees to form a tube of rectangular cross-section and a pair of end closures at opposite ends of said tube. An internal positioning frame exists within the exterior container. The internal positioning frame has a pair of generally parallel positioning panels, each such positioning panel being parallel to the first pair of main panels and both such positioning panels being connected to one of the second pair of main panels. A first positioning strut is connected between the parallel positioning panels and lies generally perpendicular to each of the parallel positioning panels and in spaced, generally parallel relation to the second pair of main panels. A second positioning strut is connected between the first positioning strut and at least one of the first pair of main panels. The second positioning strut lies generally parallel to said parallel positioning panels and in a plane intermediate the planes of said parallel positioning panels.

It is an object of the present invention to provide a rectangular carton with an improved internal structure for product positioning and holding.

It is another object of the present invention to provide a rectangular carton with an additional strut to reinforce the other internal structural elements and enhance the integrity of the internal structure of the carton.

It is a further object of the present invention to provide a rectangular carton with an additional internal reinforcing strut that is formed from paperboard that would otherwise be wastage.

These and other objectives of the present invention will become apparent with reference to the drawings, the description of the preferred embodiment that follows and the appended claims.

DESCRIPTION OF THE PREFERRED EMBODIMENT

Figure 1:
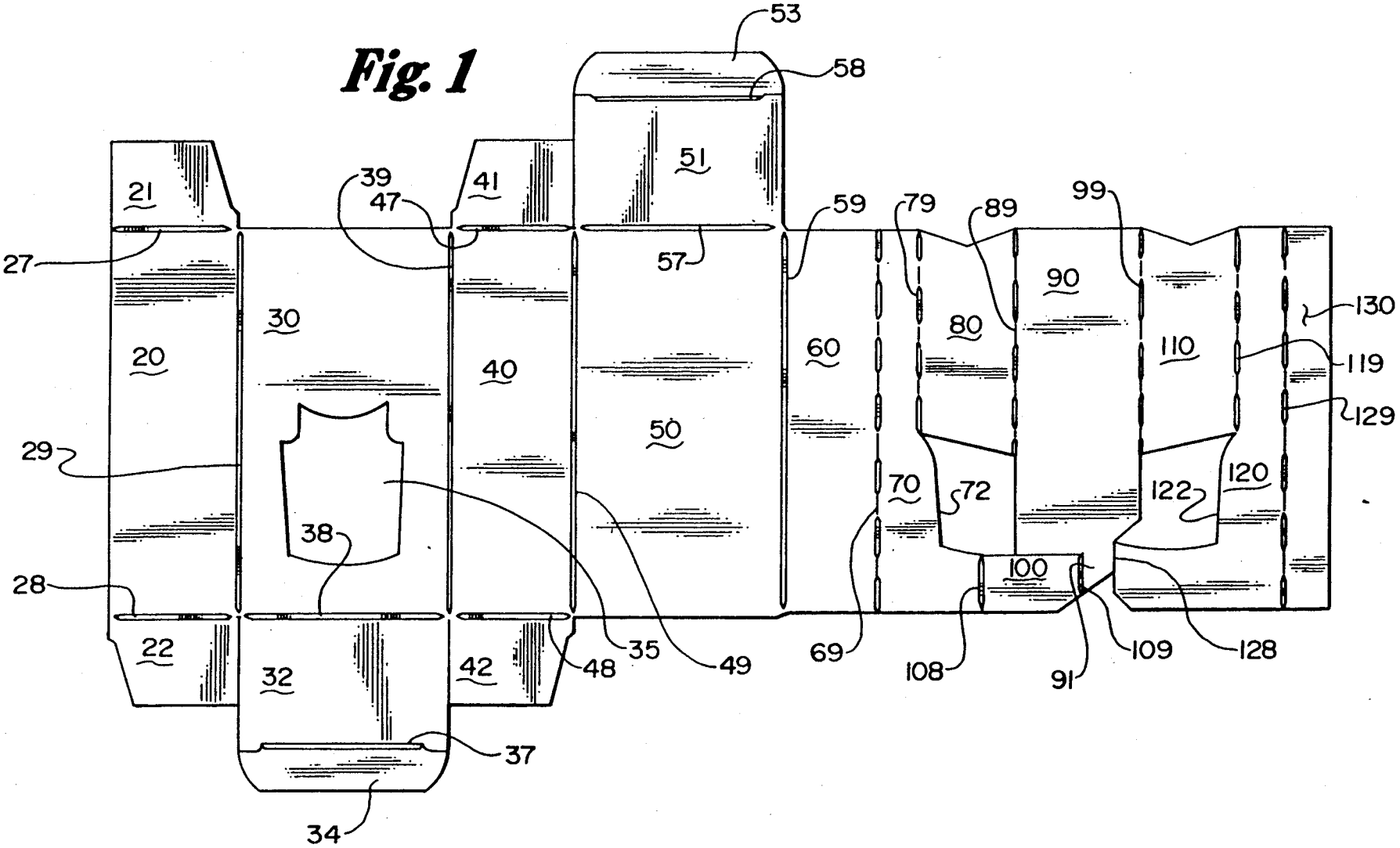
FIG. 1 is a top plan view of the present invention showing the die-cut profile of the flat blank used to form the invention.

As best seen in FIG. 1, a blank 10 for a package in accordance with the present invention comprises a single flat piece of a flexible material such as paperboard that is die cut, scored and cut-through to produce a number of panels, flaps and struts. In the drawings, double lines indicate bend scores used to form fold lines. Single solid lines indicate cuts or free edges. Double lines alternating with single lines indicate alternating cuts and bend scores that together form cut-score fold lines.

In overview, the blank 10 consists of generally rectangular panels 20, 30, 40 and 50 with associated end flaps used to form an external container and additional panels 60, 70, 80, 90, 110, 120, 130 and bridge strut 100 used to form an internal positioning frame. All of the preceding panels and associated flaps are integrally formed in the single blank 10. Turning first to the left hand side of FIG. 1, one end of the blank 10 begins with generally rectangular side panel 20 having at its top and bottom boundaries auxiliary end flaps 21, 22 joined to the side panel 20 at respective, parallel fold lines 27, 28. At fold line 29 perpendicular to fold lines 27, 28, side panel 20 is joined to generally rectangular front panel 30, which has at its bottom boundary an end closure flap 32 joined to the front panel 30 at fold line 38 perpendicular to fold line 29. Tuck flap 34 is, in turn, joined to end closure flap 32 at fold line 37 parallel to fold line 38. A product window 35 (which may be of any desired shape) is die cut out of the center of the front panel 30. A second generally rectangular side panel 40 is joined to front panel 30 at fold line 39 parallel to fold line 29. Second side panel 40 has at its top and bottom boundaries auxiliary end flaps 41, 42 joined to the second side panel 40 at respective, parallel fold lines 47, 48 perpendicular to fold line 39. Joined to second side panel 40 at fold line 49 parallel to fold line 39 is a generally rectangular back panel 50. Back panel 50 has an end closure flap 51 joined to its upper boundary at fold line 57 perpendicular to fold line 49. Tuck flap 53 is, in turn, joined to end closure flap 51 at fold line 58 parallel to fold line 57.

As will be seen below, the side panels 20, 40, being of the same size, and the front and back panels 30, 50, also being of the same size, form, respectively, the first and second main panel pairs. These main panel pairs 20, 40 and 30, 50 are folded at ninety degree angles so as to form a tube of generally rectangular cross-section that is the external container of the present invention.

At fold line 59 begin the panels that form the internal positioning frame. A first, generally rectangular, internal side panel 60 is joined to the back panel 50 at fold line 59 parallel to fold line 49. Bridge strut support panel 70, which is roughly "L"-shaped, is joined to first internal side panel 60 at a cut-score fold line 69 parallel to fold line 59. A first positioning panel 80, which is generally rectangular but somewhat irregular in shape at its top and bottom edges, is joined to the bridge support panel 70 at cut-score fold line 79 parallel to fold line 69. Internal back panel 90, which is generally rectangular in shape but has a projecting tab 91 at its bottom edge, is joined to first positioning panel 80 at cut-score fold line 89 parallel to fold line 79.

Extending between the bottom horizontal leg portion of bridge strut support panel 70 and tab 91 of internal back panel 90 is a bridge strut panel 100. The bridge strut panel 100 is joined to the bridge strut support panel 70 at a front fold line 108 and is joined to tab 91 of internal back panel 90 at a rear fold line 109.

A second positioning panel 110 is joined to internal back panel 90 at a cut-score fold line 99 parallel to fold line 89. Like first positioning panel 80, second positioning panel is generally rectangular in shape but somewhat irregular at its top and bottom edges. A horizontal strut support panel 120 shaped somewhat like a reversed "L" is connected to the second positioning panel 110 at cut-score fold line 119 parallel to fold line 99. Although in FIG. 1, it appears as if the left-most bottom end of the horizontal strut support panel 120 is connected to internal back panel 90, the boundary between these two panels is cut, leaving a free edge 128. A second internal side panel 130 of generally rectangular shape is connected to horizontal strut support panel 120 at cut-score fold line 129 parallel to fold line 119.

Figures 7, 8, 9:
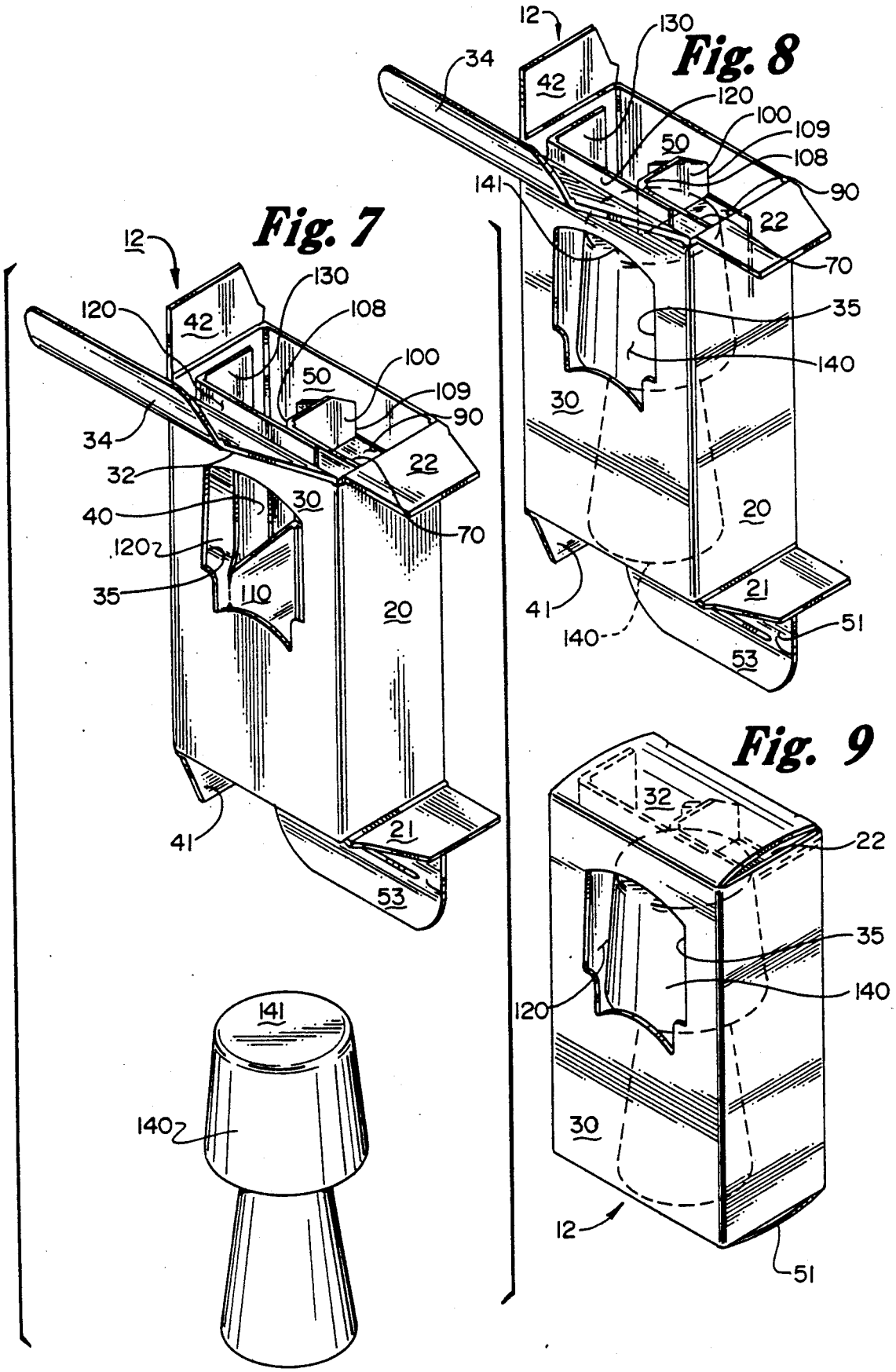
FIG. 7 is an exploded perspective view of the assembled package with the product ready for insertion and package closure.
FIG. 8 is a perspective view as in FIG. 7 with the product inserted in the package and the package ready for end closure.
FIG. 9 is a perspective view as in FIG. 8 with the product inserted and the ends of the package closed.

The manner of folding, gluing and assembling the various panels shown in FIG. 1 to form a completed package 12 in accordance with the present invention is illustrated in a step-by-step sequence in FIGS. 2 through 6. FIGS. 7 through 9 show how an article is inserted in the erected package 12 and the end closures put into place. The assembly sequence and product loading sequence will be described next.

Figure 2:
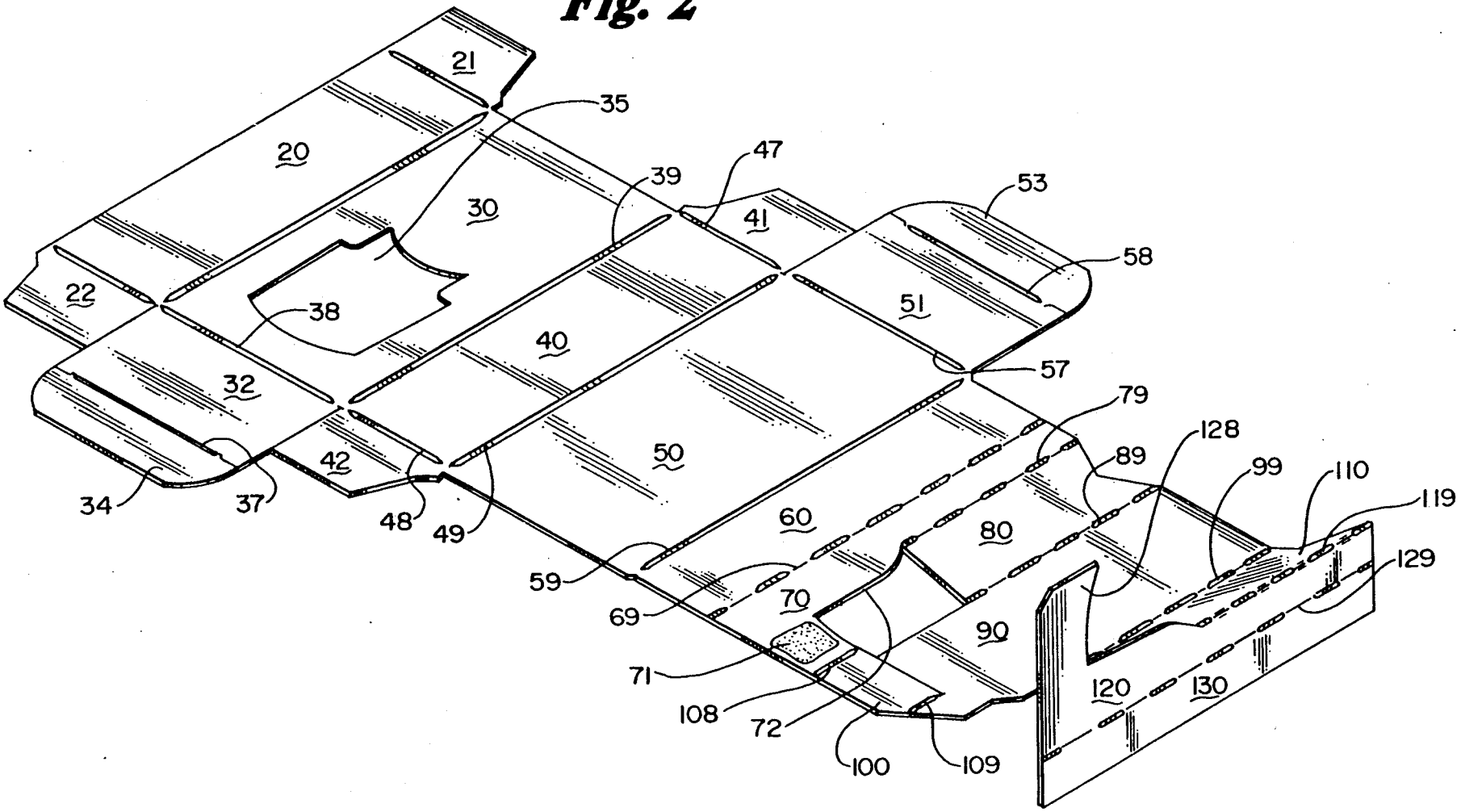
FIG. 2 is a perspective view of the blank of FIG. 1, showing bending and glue placement for an initial assembly step.
Figure 3:
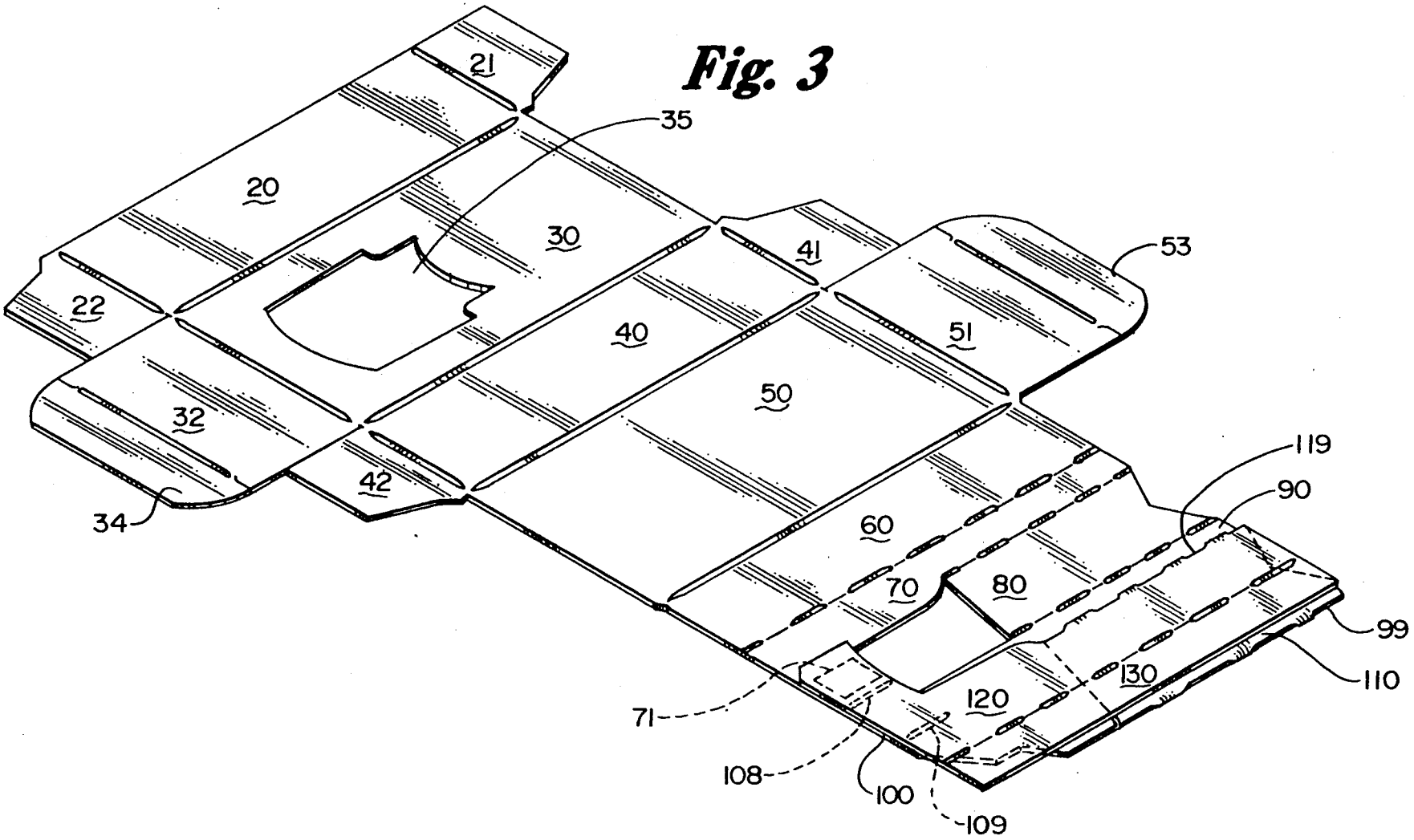
FIG. 3 is a perspective view of the blank of FIG. 2 showing a second assembly step.

As seen in FIG. 2, the first step in the assembly sequence is to fold the horizontal strut support panel 120 and the second internal side panel 130 downward at cut-score fold line 119 while also folding second positioning panel 110 upward slightly at cut-score fold line 99. As can be seen, this causes the free edge 128 of horizontal support panel 120 to separate from contact with internal back panel 90. At the same time, a patch 71 of glue or adhesive is applied to the bottom extended end of bridge strut support panel 70. Turning now to FIG. 3, it can be seen that the second step of assembly is to extend the folds at cut-score fold lines 99 and 119 to one-hundred eighty degrees in opposite directions so that panels 120 and 130 lie on top of panel 110 and panel 110 lies on top of panel 90. This brings the free edge 128 of horizontal strut support panel 120 down in the vicinity of glue patch 71 where the leftmost extension of the horizontal strut support panel 120 is attached. The bottom, horizontal leg portion of panel 120 now covers the bridge support panel 100 but is not directly attached thereto.

Figure 4:
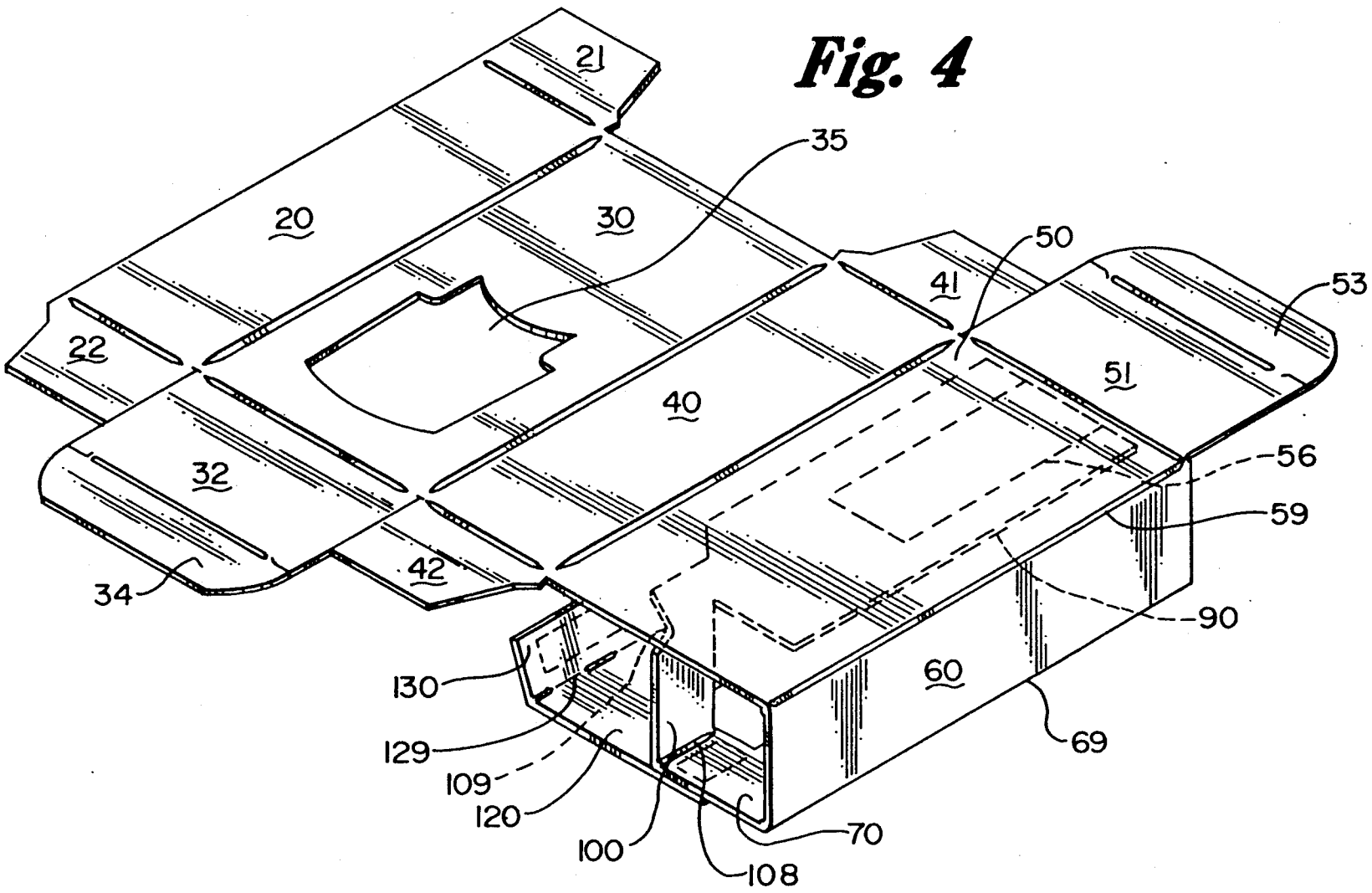
FIG. 4 is a perspective view of the blank of FIG. 3 showing a third assembly step.

Referring now also to FIG. 4, it can be seen that the next step of assembly involves ninety degree folds made at fold line 59 between back panel 50 and first internal side panel 60, at cut-score fold line 69 between bridge strut support panel 70 and first internal side panel 60, and at cut-score fold line 129 between horizontal strut support panel 120 and second internal side panel 130. In addition, the formerly flattened structure formed by panels 70, 80, 90, 100, 110 and 120 (FIG. 3) is erected by making ninety degree bends at cut-score fold lines 79, 89, 99 and 119 and also at fold lines 108 and 109, at opposing ends of the bridge strut panel 100. The folds are made so that panel 90 rotates away from panel 110 and becomes parallel to and spaced from panels 70 and 120. Panels 80 and 110 become perpendicular to panel 90. To hold this internal structure in place, a glue patch 56 is applied to the surface between back panel 50 and internal back panel 90, which now lie in contact with each other.

Figures 5, 6:
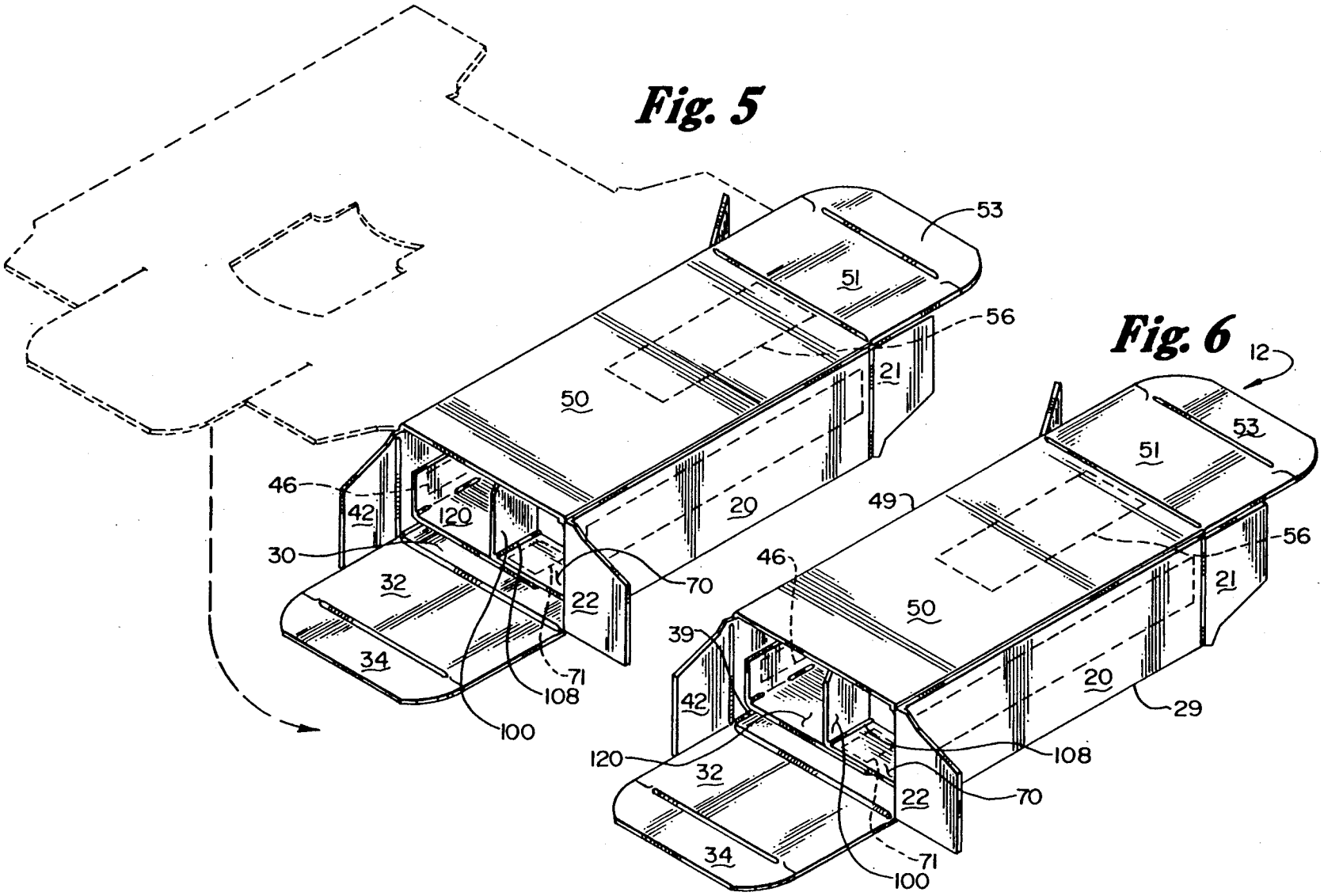
FIG. 5 is a perspective view of the blank of FIG. 4 showing a fourth assembly step.
FIG. 6 is a perspective view of the blank of FIG. 5 showing pre-loading assembly completed.

FIGS. 5 and 6 show the remaining assembly of the exterior container. This occurs by further ninety degree bends at fold lines 29, 39 and 49, which cause the panels 20, 30, 40 and 50 to form a rectangular tube around the internal positioning frame structure formed by panels 60, 70, 80, 90, 100, 110, 120 and 130. This folding sequence causes front panel 30 to lie in parallel, spaced relation to the composite structure formed by bridge strut support panel 70 and horizontal strut support panel 120. The ends of "L"-shaped panels 70, 120 affixed to each other at glue patch 71 form a first positioning strut that is connected between the positioning panels 80, 110 and is supported at its center by bridge strut panel 100, forming the second positioning strut. To hold the internal positioning frame in place within the exterior container, internal side panel 130 is affixed to the interior of side panel 40 at a glue patch 46.

With the side panels 20, 40, forming a first main panel pair, and the front and back panels 30, 50, forming a second main panel pair, assembled in the form of a rectangular tube, the package 12 is now ready for product insertion and closure. As best seen in FIGS. 7–9, an irregularly shaped product such as roll-on deodorant bottle 140 can be inserted into the package 12 at the tube end opposite the location of bridge strut panel 100. Specifically, as shown in FIG. 8, the product 140 is inserted between first and second positioning panels 80, 110 (not visible in FIG. 8) to lie against internal back panel 90 and behind bridge strut support panel 70 and horizontal strut support panel 120. The top 141 of the product 140 comes into contact with or is adjacent to bridge strut panel 100, which extends generally perpendicular from rear fold line 109 at internal back panel 90 to front fold line 108, where horizontal strut support panel 120 is affixed to bridge strut support panel 70 at glue patch 71. Thus, the strut extending between the first main panel pair 20, 40 is supported and maintained in position by bridge strut panel 100 so that it cannot easily be displaced and thereby permit product 140 to slip from its position. The product 140 remains attractively framed by product window 35 and contoured interior edges 72, 122 of panels 80 and 110, which follow the outlines of product window 35. The "L"-shaped interior edges 72, 122 of first positioning panel 70 and second positioning panel 120 form an internal aperture behind the product window 35 through which the product 140 is visible.

As best seen in FIGS. 8 and 9, the end closures of the open ends of the rectangular tube formed by panels 20, 30, 40 and 50 are formed by first folding inwardly auxiliary end flaps 21, 41 and 22, 42 at their respective ends, then folding end closure flaps 51, 32 together with their respective tuck flaps 53, 34 to fit down inside the respective ends of the exterior container. To avoid interference with tuck flap 34, the outer corner of bridge strut panel 100 nearest rear fold line 109 is removed. In addition, no glue is placed behind tab 91 projecting from internal back panel 90 so that tuck flap 34 can rest between tab 91 and back panel 50.

In summary, it can be seen that the present invention provides a package that can be manufactured as a flat blank and sold in that form for erection to form a package or container with an internal positioning frame that holds the contained product against both side to side motion and upward motion against the bridge strut panel 100. Moreover, it can be seen that the bridge strut panel 100 is formed from material extending between two panels that in prior designs was trimmed off in the die cutting process and became wastage. The finished package of the present invention is an attractive rectangular carton with tuck-in end closures that effectively positions the contained product in front of a double frame product window.

Although a description of the preferred embodiment has been presented, it is contemplated that various changes could be made without deviating from the spirit of the present invention. For example, while the preferred embodiment shows two end closures with a tuck end construction, it will be seen that sealed flaps can be used as well. Moreover, it will be observed that a variety of product window shapes can be produced and that the package could be produced with some variation from exact ninety degree folds, so long as the basic internal positioning panel and strut structure is preserved. Accordingly, it is intended that the scope of the present invention be dictated by the appended claims, rather than by the description of the preferred embodiment.

I claim:

1. A package of thin, flexible material for positioning an article contained within the package comprising:

an exterior container having generally the shape of a rectangular box comprising first and second opposed main panel pairs joined at ninety degrees to form a tube of generally rectangular cross-section and a pair of end closures at opposite ends of said tube; and an internal positioning frame within said exterior container, said internal positioning frame comprising:

a pair of generally parallel positioning panels, each such positioning panel being generally parallel to the first pair of main panels;

a first positioning strut connected between the first pair of main panels and lying generally perpendicular to each of the parallel positioning panels and in spaced, generally parallel relation to the second pair of main panels; and a second positioning strut connected between said first positioning strut and at least one of said second pair of main panels, said second positioning strut lying generally parallel to said parallel positioning panels and in a plane intermediate the planes of said parallel positioning panels.

2. A package as recited in claim 1 wherein the package is made of paperboard.

3. A package as recited in claim 1 wherein the parallel positioning panels and the first positioning strut are integrally formed from a single piece of paperboard.

4. A package as recited in claim 1 wherein both of the positioning panels are connected to one of the second pair of main panels.

5. A package as recited in claim 4 wherein the second positioning strut is connected between the first positioning strut and the same one of said second pair of main panels as the parallel positioning panels are connected to.

6. A package as recited in claim 1 wherein the exterior container and the internal positioning frame are all integrally formed from a single piece of paperboard.

7. A package as recited in claim 1 wherein one of said second pair of main panels has a display window in it.

8. A package as recited in claim 1 wherein the pair of generally parallel positioning panels is joined by an internal back panel lying therebetween that is parallel to and affixed to one of said second pair of main panels.

9. A package as recited in claim 8 wherein the second positioning strut extends generally perpendicularly from the internal back panel to connect to the first positioning strut.

10. A package as recited in claim 9 wherein the first positioning strut is formed by connecting the ends of two generally "L"-shaped internal support panels, each of which lies generally perpendicular to and is connected to one of said first pair of main panels.

11. A package blank comprising:

first, second, third and fourth generally rectangular main panels consecutively joined at first, second and third parallel fold lines, a first generally rectangular internal side panel joined to said fourth main panel at a fourth fold line parallel to said third fold line;

a first generally "L"-shaped support panel having a horizontal leg, said first support panel being joined to said internal side panel at a fifth fold line parallel to said fourth fold line;

a first generally rectangular positioning panel joined to said first support panel at a sixth fold line parallel to said fifth fold line;

a generally rectangular internal back panel joined to said first positioning panel at a seventh fold line parallel to said sixth fold line, said internal back panel having a tab extending from one end adjacent a horizontal leg of said first support panel;

a bridge strut panel joined to the horizontal leg of the first support panel at a front fold line and to the tab extending from the internal back panel at a rear fold line, each such front and back fold line being parallel to said seventh fold line, a second generally rectangular positioning panel joined to said internal back panel at an eighth fold line parallel to said seventh fold line;

a second generally reverse "L"-shaped support panel joined to said second positioning panel at a ninth fold line parallel to said eighth fold line;

a second generally rectangular internal side panel joined to said second support panel at a tenth fold line parallel to said ninth fold line; and first and second end closure flap assemblies connected to said first, second, third and fourth main panels at end closure fold lines perpendicular to said first, second and third fold lines.

12. A package blank as claimed in claim 11 wherein said second main panel has a display window cut into its center.

13. A package as recited in claim 10 wherein one of the second pair of main panels has a product window opening therein and the two generally "L" shaped internal support panels together form an internal aperture located between said product window opening and an inserted product.

14. A package as recited in claim 13 wherein the product window opening is symmetrically located between the planes of the first pair of main panels and the generally "L" shaped internal support panels together form an internal aperture symmetrically framing at least a portion of said inserted product.

* * * * *